United States Patent [19]

McCoy et al.

[11] 4,251,349

[45] Feb. 17, 1981

[54] FIXED-BED REFORMING WITH MID-CYCLE CATALYST ADDITION

[75] Inventors: Charles S. McCoy, Orinda; Robert J. Houston, San Rafael, both of Calif.

[73] Assignee: Chevron Research Company, San Francsico, Calif.

[21] Appl. No.: 45,534

[22] Filed: Jun. 4, 1979

[51] Int. Cl.[3] ..... C10G 35/04; C10G 35/08

[52] U.S. Cl. ..... 208/64; 208/65; 208/139

[58] Field of Search ..... 208/138, 65, 139, 64

[56] References Cited

U.S. PATENT DOCUMENTS 4,119,530 10/1978 Czajkowski et al. ..... 208/213

*Primary Examiner*—Curtis R. Davis

*Attorney, Agent, or Firm*—D. A. Newell; M. K. Bosworth; W. L. Stumpf

[57] ABSTRACT

A fixed-bed catalytic reforming process in which on-stream operation is begun with the catalyst retention volume in the first reactor less than 99% full and additional catalyst is added to said reactor while on-stream.

6 Claims, 3 Drawing Figures

EFFECT OF FRESH CATALYST ABOVE COKED CATALYST

YIELD LOSSES DUE TO COKE AT TOP OF CATALYST BED
10% LAYER, VARIABLE CARBON CONTENT OVER
90% LAYER (13.3% CARBON)

FIXED-BED REFORMING WITH MID-CYCLE CATALYST ADDITION

FIELD OF THE INVENTION

The present invention is directed to the catalytic reforming of hydrocarbon fractions. More specifically, the present invention concerns reforming with a platinum-containing catalyst disposed in a fixed-bed reactor to improve the octane rating of the feed.

BACKGROUND OF THE INVENTION

Reforming of a naphtha fraction is generally accomplished by passing the naphtha through a reaction zone having one or more reactors. These reactors may contain one or more fixed beds of catalyst comprising a hydrogenation-dehydrogenation component supported on a porous solid carrier. Typical catalysts include platinum on alumina with or without such promoters such as rhenium, tin, iridium, etc. When a plurality of reactors is used, the naphtha fraction to be reformed is contacted in the first reactor with a platinum-containing catalyst at reaction conditions to convert principally naphthenes to aromatics. In addition to naphthene dehydrogenation, side reactions such as isomerization, hydroisomerization and hydrocracking may also occur. Typically, the effluent from the first reactor is heated prior to being introduced to a subsequent reactor.

After a period of use in reforming, the catalyst becomes gradually deactivated due to the deposition of coke on the surface of the catalyst and consequently a decrease of the octane values of the reformate product is observed.

If the octane requirements imposed upon the particular reforming system are to be continuously met, the reaction temperature of the catalyst must be increased in order to compensate for the loss in activity due to the coke deposition. The fastest catalyst deactivation occurs in the reactor where paraffin dehydrocyclization and hydrocracking are the principal reactions. Consequently, even with a constant inlet temperature, the average reaction temperature increases with each successive reactor, because the reactions in each successive reactor are not as endothermic as in the preceding reactor.

Coke deposition on the catalyst not only decreases the activity of the catalyst but also results in a decrease in the yield of $C_5+$ gasoline product produced. Thus, the yield of $C_5+$ gasoline product generally declines throughout the reforming process until it reaches an unacceptable level, at which point common practice is to regenerate all or part of the catalyst. Typical coke levels on the catalyst at the time of regeneration are 10 to 12 weight percent or more on the catalyst in the last reactor and 5 or 6 weight percent on the catalyst in the first reactor. Coke levels on catalysts in intermediate reactors will generally fall between these two figures.

SUMMARY OF THE INVENTION

It is an object of this invention to provide a fixed-bed reforming process having an extended operating cycle between regenerations when compared with ordinary reforming processes. It is another object of this invention to provide a method for extending the effective life of a reforming catalyst which is nearing the end of the run.

In accordance with one embodiment of the present invention there is provided for a reforming process in which a hydrocarbon feedstock and hydrogen are contacted at reforming conditions in a reaction zone having at least a first reactor in which platinum-containing catalyst is disposed in a fixed-bed through which the feedstock and hydrogen flow in a downward direction, the improvement which comprises (a) starting on-stream operation of said reforming zone with the catalyst retention volume of said first reactor less than 99 volume % full, and subsequently (b) charging from 0.5 to 30 volume %, and preferably 1 to 10 volume % fresh or regenerated platinum-containing catalyst based on the existing catalyst volume in the reaction zone, to the top of the existing catalyst in the first reactor while the reaction zone is maintained on-stream.

DETAILED DESCRIPTION

Figure 1:
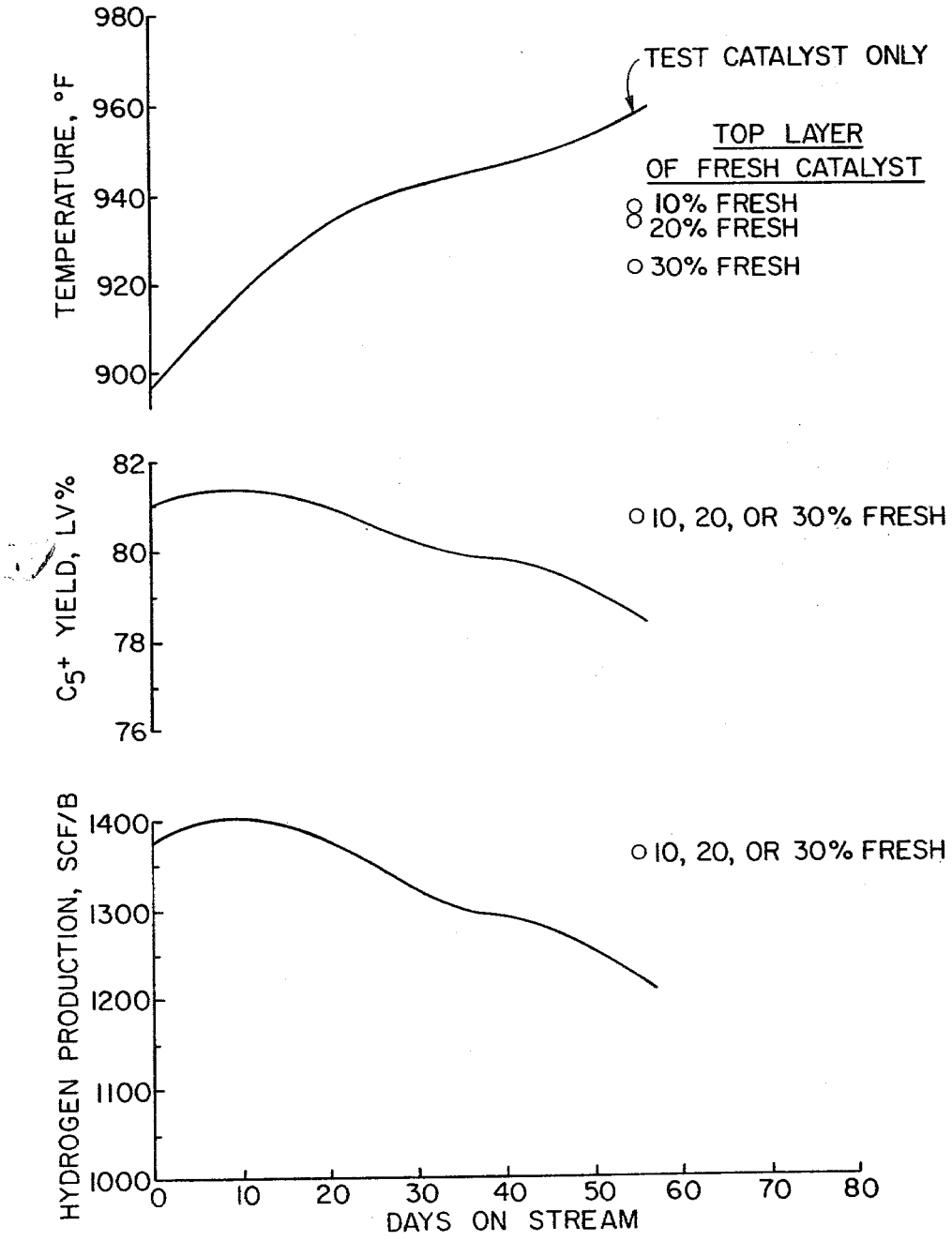
FIG. 1 illustrates the effect on reaction temperature, $C_5+$ yield and hydrogen production of a catalyst bed containing 0, 10, 20 and 30% fresh catalyst on top of a layer of coked catalyst.

The present invention is applicable to those reforming systems containing one or more reactors having fixed beds of catalyst. When multiple beds or multiple reactors are used, preheaters may be present between catalyst beds or reactors so that the temperature of the feed may be controlled. Preferably, the catalyst in each reactor will be disposed in one or more fixed beds. The first reactor is a downflow reactor and any subsequent reactors may be downflow, upflow, or preferably radial flow.

In multi-reactor reforming systems, the catalyst may vary in composition in the different reactors, although generally the catalyst is the same in all of them. Where more than one reactor is used, the volume of catalyst generally differs from one reactor to the next. A typical catalyst loading in a three-reactor system may employ one-quarter of the total charge of catalyst in the first reactor, one-quarter in the second reactor and one-half in the last reactor. The first reactor generally contains less catalyst because the highly endothermic reaction taking place therein results in the rapid cooling of the feed. If a large volume of catalyst were present in the first reactor, the temperature of the feed in the lower portion of the catalyst bed would be too low for significant dehydrogenation reactions to occur and thus the lower portion of the catalyst bed would not be used effectively.

To achieve the benfits of the present invention, catalyst should be added on top and upstream of the existing catalyst in the first reactor, such that the feed will contact the newly added catalyst before contacting the remaining catalyst.

The temperature in each of the reactors can be the same or different, but generally it will fall in the range from 700° F. to 1050° F. and preferably within the range of about 850° F. to 1000° F. The terminal reactor generally has the highest average catalyst bed temperature. The pressure in each of the reactors will usually be the same, either atmospheric or superatmospheric. Preferably, the pressure will be in the range of 25 to 1000 psig and more preferably between 50 and 750 psig. The temperature and pressure can be correlated with the liquid hourly space velocity (LHSV) to favor any particularly desirable reforming reactions and will generally be from 0.01 to 10 and preferably from 1 to 5. It is apparent that with different catalyst loadings, the space velocities in the individual reactors can vary considerably.

Although reforming generally results in the production of hydrogen, it is common to recycle hydrogen separated from the effluent of any of the reactors, usually the terminal reactor, to the first or subsequent reaction zones. The hydrogen can be admixed with the feed prior to contacting catalyst or simultaneously with the introduction of the feed to the reactor or reactors. The presence of hydrogen serves to reduce formation of coke which tends to poison the catalyst. Hydrogen is preferably introduced into the reforming reaction zone at a rate which varies from 0.5 to 20 mols of hydrogen per mol of feed. Hydrogen can be an admixture with light gaseous hydrocarbons.

The catalyst used in the reaction zone comprises a platinum group component in association with a porous solid carrier. Preferably the platinum group component is platinum and the preferred porous solid carrier is a porous refractory inorganic oxide, for example, alumina. The platinum group component will be present in an amount of from 0.01 to 3 weight percent and preferably 0.1 to 1 weight percent.

Other components in addition to the platinum group component may be present on the porous solid carrier. It is particularly preferred that rhenium be present, for example in an amount of 0.01 to 5 weight percent and more preferably 0.01 to 2 weight percent. Rhenium significantly improves the yields obtained using a platinum-containing catalyst, and a platinum-rhenium catalyst is more fully described in U.S. Pat. No. 3,415,737. Generally, the catalyst will be promoted for reforming by the addition of a halide, particularly fluoride or chloride. The halide provides a limited amount of acidity to the catalyst which is beneficial to most reforming operations. The catalyst promoted with halide preferably contains 0.1 to 3 weight percent total halide content and the preferred halide is chloride.

The hydrocarbon feedstock employed in the reforming operation of the present invention may be any suitable hydrocarbon capable of being catalytically reformed at the stated conditions. Preferably, the feedstock is a naphtha fraction, which is a light hydrocarbonaceous oil generally boiling within the range from 70° to 550° F. and preferably from 150° to 450° F. The feedstock may be, for example, either a straight-run naphtha, a thermally cracked or catalytically cracked naphtha or blends thereof. Generally the naphtha feed will contain from about 25% to 75% and preferably about 35% to 60% paraffins, about 15% to 65% and preferably about 25% to 55% naphthenes and about 5% to 20% aromatics, calculated on a volume percent basis.

EXAMPLES

The present invention will be further clarified by consideration of the following examples which are intended to be purely exemplary and not limiting of this invention. Example 1 shows that the presence of a small amount of fresh catalyst on top of the bed of catalyst containing 10.9% carbon acts to substantially increase the $C_5+$ yield and hydrogen production as well as to decrease the average catalyst temperature required to make a product of a predetermined octane. These results indicate that the presence of a small amount of fresh catalyst upstream of a larger mass of coke-contaminated catalyst serves to significantly extend the length of time which the total mass of catalyst can be maintained in reforming service before being regenerated. Example 2 shows the adverse effect on yield due to the presence of an increasing amount of coke on a small mass of catalyst situated above a larger mass of coke-deactivated catalyst. These results indicate that the less carbon that is present on the catalyst in the first reaction zone, the better the overall yield. Example 3 is a side-by-side comparison of reforming with a catalyst bed containing 10% fresh catalyst on top of a bed to test catalyst containing various levels of coke which illustrates the activity and yield advantages of having a small layer of fresh catalyst present in the top of the catalyst bed.

EXAMPLE 1

A mid-continent naphtha having the characteristics shown in Table I was passed through a series of four reactors containing a platinum-rhenium reforming catalyst at reforming conditions including a pressure of 200 psig, a liquid hourly space velocity of 2, a hydrogen to hydrocarbon mol ratio of 3 and a temperature adjusted to obtain a reformate product having a research octane number of 98 clear.

TABLE I

| Mid-Continent Naphtha | |
|---|---|
| Gravity °API | 55.0 |
| D-86 Distillation | |
| IBP - °F. | 174 |
| 10% - °F. | 214 |
| 30% - °F. | 239 |
| 50% - °F. | 263 |
| 70% - °F. | 294 |
| 90% - °F. | 342 |
| EP - °F. | 390 |
| % Paraffins | 43.1 |
| % Naphthenes | 46.8 |
| % Aromatics | 10.0 |

After 55 days on-stream, a portion of the catalyst was removed from the last reactor in the series. The catalyst, averaging 10.9 weight percent coke, was tested in a micro-sized pilot plant reformer in three separate tests in which the top 10%, 20% and 30% of the used catalyst replaced by an equivalent amount of fresh catalyst. The results, as represented in FIG. 1 and Table II show that by placing a layer of fresh catalyst on top of a larger mass of coked catalyst, (1) the activity of the total mass of catalyst increased significantly, by 19° F. for 10% fresh catalyst, by 22° F. for 20% fresh catalyst, and by 32° F. for 30% fresh catalyst; (2) the $C_5+$ yield increased by 1.9 liquid volume percent, from approximately 78.6 to 80.5 LV percent; (3) the hydrogen production increased by amount 11%, from 1217 standard cubic feet per barrel of feed to 1356–1347 standard cubic feet per barrel of feed; and (4) $CH_4$ production decreased 23–26%, from 108 standard cubic feet per barrel of feed to 80–83 standard cubic feet per barrel of feed. Thus, the presence of a small amount of fresh catalyst on top of a larger amount of coked catalyst serves to substantially increase the activity, $C_5+$ liquid yield and rate of hydrogen production, far more than would be predicted just from the small amount of fresh catalyst added.

TABLE II

| Layered-Bed Tests on End-of-Run Catalyst | | | | |
|---|---|---|---|---|
| | $T_o$, °F. | $C_5$ +, LV% | $H_2$, SCF/B | $CH_4$, SCF/B |
| End-of-Run (EOR) Catalyst, 10.9% C. | 955 | 78.6 | 1217 | 108 |
| 10% Fresh over 90% EOR Catalyst | 936 | 80.6 | 1356 | 82 |
| 20% Fresh over 80% EOR Catalyst | 933 | 80.5 | 1347 | 80 |
| 30% Fresh over 70% EOR Catalyst | 923 | 80.5 | 1349 | 83 |

EXAMPLE 2

Figure 2:
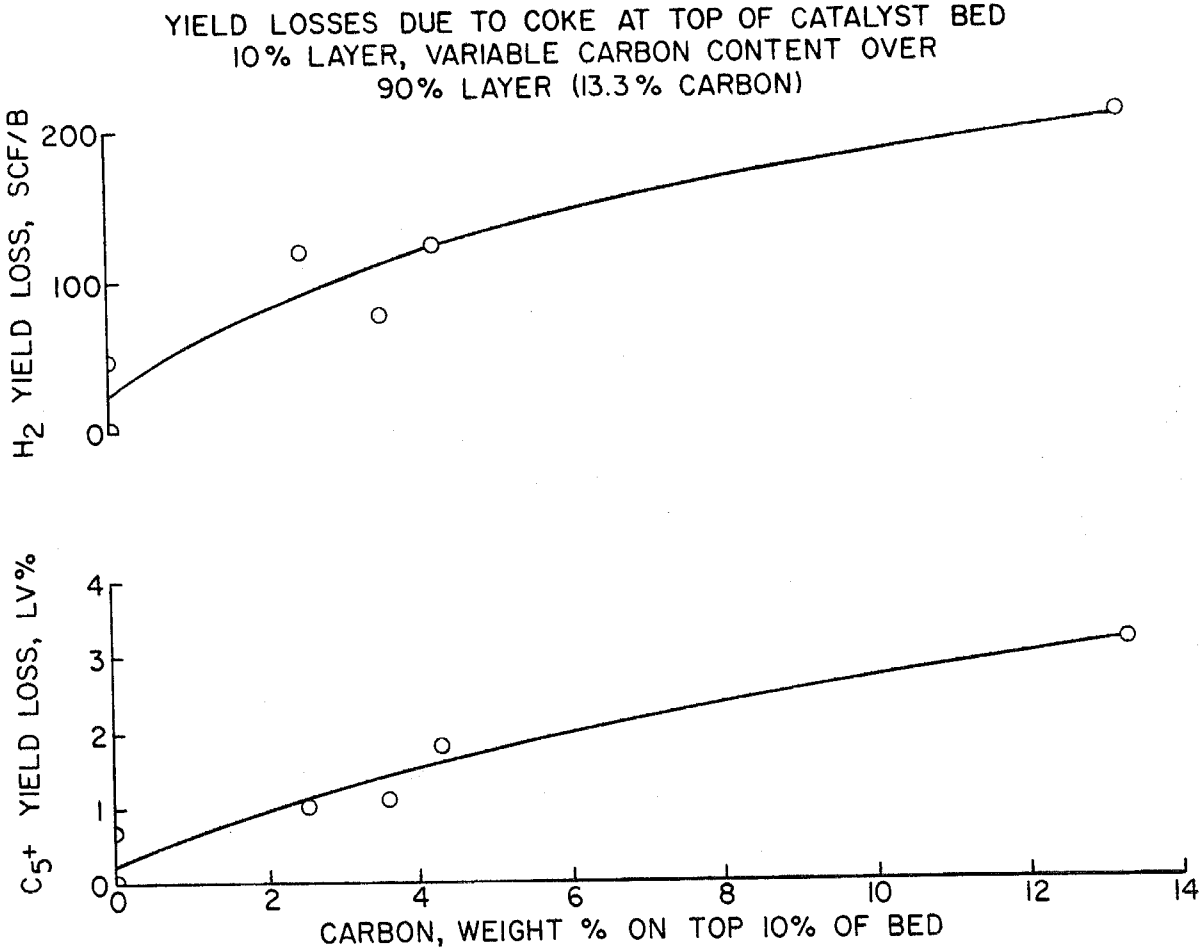
FIG. 2 illustrates yield losses due to variable levels of coke on catalyst at the top of a bed of coked catalyst.
Figure 3:
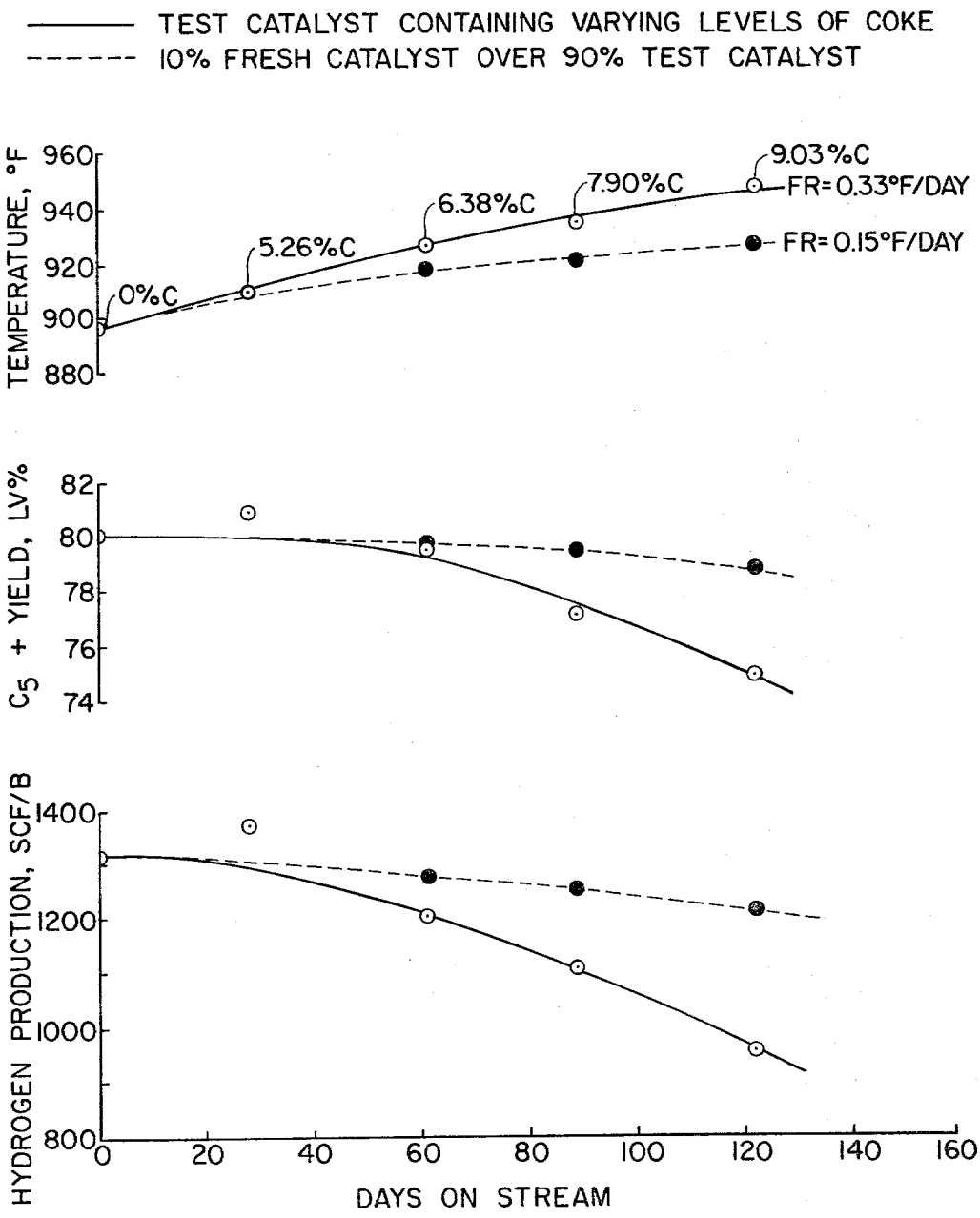
FIG. 3 illustrates the results of a comparison between reforming with coked catalyst and with 10% fresh catalyst on top of coked catalyst.

A study was made to determine the effect on yield of a varying amount of coke on the top 10% of catalyst in a catalyst bed. FIG. 2 shows the effect on $C_5$+ yield and $H_2$ yield associated with an increasing carbon content on the catalyst in the top 10% of the catalyst bed. Using as the standard a catalyst bed containing 10% fresh catalyst on top of 90% catalyst containing 13.3 weight percent carbon, a catalyst bed with the top 10% of catalyst containing 2 weight percent carbon loses 1% by volume of $C_5$+ yield; a catalyst bed with the top 10% of catalyst containing about 6 weight percent carbon loses 2% by volume of $C_5$+ yield; and a catalyst bed with the top 10% of catalyst containing about 12 weight percent carbon loses about 3% by volume of $C_5$+ yield. Hydrogen yield loss also increases in the same manner with increasing carbon content in top 10% of the catalyst in the catalyst bed. Thus, to obtain the maximum yield benefit from the process of this invention, the amount of carbon on the catalyst in the top of the catalyst bed should be kept as low as possible.

EXAMPLE 3

A test was conducted to compare the performance of a bed of coke-deactivated platinum-rhenium catalyst with an equivalent volume of catalyst comprising 10 volume % fresh catalyst on top of 90% of the deactivated catalyst. Samples of catalyst from a commercial reformer were obtained at approximately 0, 28, 61, 89 and 122 days on stream. One portion of each catalyst sample was tested on the feedstock shown in Table I at reforming conditions including a pressure of 200 psig, a liquid hourly space velocity of 2, a hydrogen to hydrocarbon mol ratio of 3 and a temperature adjusted to obtain a reformate product having a research octane number of 98, clear. A layer of 10% fresh catalyst was put on top of a 90% layer of catalyst from the 61, 89 and 122-day samples, respectively, and then tested under the same reforming conditions.

The results, as shown in FIG. III, demonstrate that the catalyst beds containing 10% fresh catalyst are far more active (20° F. after 120 hours) and more selective (4% $C_5$+ yield after 120 hours) than the beds containing only coked catalyst. The fouling rate for the beds containing 10% fresh catalyst is less than that for the beds of coked catalyst—0.15° F./day vs. 0.33° F./day, indicating that the effect of the fresh catalyst is far out of proportion to its volumetric presence.

From the foregoing, it may be seen that the present invention operates in a novel and effective manner to increase the activity, selectivity ($C_5$+ yield) or both of the total mass of catalyst in a reforming reaction zone, and thus it permits the service life of the bulk of catalyst to be extended before regeneration or replacement is necessary.

Although only specific arrangements and modes of operation of the present invention have been described, numerous changes can be made in those arrangements without departing from the spirit of the invention and also changes that fall within the scope of the appended claims are intended to be embraced thereby.

What is claimed is:

1. In a catalytic reforming process in which a hydrocarbon feedstock and hydrogen are contacted at reforming conditions in a reaction zone having at least a first reactor in which platinum-containing catalyst is disposed in a fixed-bed through which the feedstock and hydrogen flow in a downward direction, the improvement which comprises:

(a) starting on-stream operation of said reforming zone with the catalyst retention volume of said first reactor less than 99 volume % full, and subsequently (b) charging 0.5 to 30 volume 5 fresh or regenerated platinum-containing catalyst based upon the existing catalyst volume in the reaction zone to the top of the existing catalyst in said first reactor while said reaction zone is maintained on-stream.

2. The process of claim 1 wherein in step (b) 1 to 10 volume % catalyst is charged to said reactor.

3. The process of claim 1 wherein step (b) is repeated from one to six times.

4. The process of claim 1 wherein said reaction zone contains a plurality of reactors in series.

5. The process of claim 4 wherein all reactors but the first are radial flow reactors.

6. The process of claim 1 wherein said catalyst comprises 0.01–3 weight percent platinum, 0.01–5 weight percent rhenium and 0.1–3 weight percent halide in association with an alumina carrier.

* * * * *

UNITED STATES PATENT AND TRADEMARK OFFICE

CERTIFICATE OF CORRECTION

PATENT NO. : 4,251,349

DATED : February 17, 1981

INVENTOR(S) : Charles S. McCoy and Robert J. Houston

It is certified that error appears in the above-identified patent and that said Letters Patent are hereby corrected as shown below:

Col. 4, line 15, "bed to test" should read --bed of test--.

Col. 6, line 37, "volume 5" should read --volume %--.

Signed and Sealed this

*Fifth* Day of *May 1981*

[SEAL]

*Attest:*

RENE D. TEGTMEYER

*Attesting Officer* *Acting Commissioner of Patents and Trademarks*